US005976420A

United States Patent [19]

Nakamura et al.

[11] Patent Number: 5,976,420

[45] Date of Patent: Nov. 2, 1999

[54] CHIP TYPE VARISTOR AND CERAMIC COMPOSITIONS FOR THE SAME

[75] Inventors: Kazutaka Nakamura; Kazuhiro Kaneko, both of Shiga-ken, Japan

[73] Assignee: Murata Manufacturing Co., Ltd., Japan

[21] Appl. No.: 09/021,726

[22] Filed: Feb. 11, 1998

[30] Foreign Application Priority Data

Feb. 17, 1997 [JP] Japan ..... 9-032027

[51] Int. Cl.[6] ..... H01B 1/04; H01C 7/10; H01C 7/118

[52] U.S. Cl. ..... 252/516; 252/519.51; 252/519.52; 252/519.54; 252/521.3; 252/521.4; 338/21

[58] Field of Search ..... 252/516, 519.51, 252/519.52, 519.54, 521.3, 521.4; 338/21

[56] References Cited

U.S. PATENT DOCUMENTS

| | | | |
|---|---|---|---|
| 4,209,474 | 6/1980 | Prochazka | 264/29.5 |
| 4,272,411 | 6/1981 | Sokoly et al. | 252/516 |
| 4,569,921 | 2/1986 | Omori et al. | 501/88 |
| 4,796,077 | 1/1989 | Takeda et al. | 357/67 |

*Primary Examiner*—Mark Kopec
*Attorney, Agent, or Firm*—Ostrolenk, Faber, Gerb & Soffen, LLP

[57] ABSTRACT

There is provided a chip type varistor having a small electrostatic capacity, high voltage non-linearity, and high voltage suppressing capability and surge resistance. The chip type varistor is a layered body formed by a plurality of ceramic layers mainly composed of SiC containing at least two elements, in the form of oxides, selected from among Si, Bi, Pb, B and Zn, an inner electrode layer interposed between the ceramic layers of the layered body, and an outer electrode formed on the surface of the layered body and electrically connected to the inner electrode layer.

22 Claims, 1 Drawing Sheet

CHIP TYPE VARISTOR AND CERAMIC COMPOSITIONS FOR THE SAME

BACKGROUND OF THE INVENTION

1. Field of the Invention

The present invention relates to a variable resistor ("varistor"), particularly to a chip type varistor and ceramic compositions for the same.

2. Description of Related Art

A varistor is a circuit element whose resistance abruptly decreases when the voltage applied to the element exceeds a predetermined level. On the other hand, the resistance is extremely large when the applied voltage is lower than that level. Because of such characteristics, varistors are used for protecting semiconductor elements from a surge voltage, for example.

Varistors made of various materials and having various structures are known. For example, varistors with lead wire are made from SiC system, ZnO system, $SrTiO_3$ system or $TiO_2$ system materials. Some chip type varistors include ZnO or $SrTiO_3$ as main components.

The current trend toward smaller circuits for high frequencies necessitates electronic components that accommodate smaller sizes and higher frequencies, and the trend toward lower circuit driving voltages necessitates components that operate on low voltages.

Therefore, it is preferable that varistors have a small electrostatic capacity to be compatible with the high frequencies and to be usable to absorb noises in signal circuits and the like, and the voltages of such varistors must be limited to small values in order for them to operate low voltages.

In the case of ZnO type varistors, however, the area of the electrodes thereof must be significantly reduced to obtain a small electrostatic capacity and a varistor voltage of a few volts since they have high apparent dielectric constants that are as high as several hundreds. However, this results in a reduction in surge resistance at the same time.

In the case of the $SrTiO_3$ type and $TiO_2$ type varistors, the apparent dielectric constants are higher than those of ZnO type varistors and can be on the order of several thousands or several tens of thousands, but it is more difficult to obtain a small electrostatic capacity and a varistor voltage of a few volts.

Meanwhile, it is easier to obtain SiC type varistors having a small capacity because they have low apparent dielectric constants. However, they have a voltage non-linearity coefficient a smaller than those of other types of varistors. For example, the constant $\alpha$ is only about 7 for SiC type varistors while it is several tens for ZnO type resistors.

SUMMARY OF THE INVENTION

It is therefore an object of the present invention to provide a chip type varistor having a small electrostatic capacity, high voltage non-linearity, and high voltage suppressing capability and surge resistance.

According to a first aspect of the present invention, there is provided a varistor comprising:

a layered body formed by a plurality of ceramic layers mainly composed of SiC containing at least two kinds of elements, in the form of oxides, selected from Si, Bi, Pb, B and Zn;

an inner electrode layer interposed between the ceramic layers of the layered body; and an outer electrode formed on the surface of the layered body and electrically connected to the inner electrode layer.

According to a second aspect of the invention, the varistor contains the at least two elements selected from Si, Bi, Pb, B and Zn in a total amount in the range from about 0.1 to 20 mol % calculated in terms of the total amount of the oxides $SiO_2$, $Bi_2O_3$, PbO, $B_2O_3$ and ZnO.

According to a third aspect of the invention, the SiC of the varistor has a grain diameter in the range from about 1 to 10 $\mu$m.

According to a fourth aspect of the invention, the inner electrode layer of the varistor is formed from at least one metal among Pt, Au, Ag, Pd, Ni and Cu.

The present invention thus provides a chip type varistor having a small electrostatic capacity, high voltage non-linearity, and high voltage suppressing capability and surge resistance.

DETAILED DESCRIPTION OF PREFERRED EMBODIMENT

Figure 1:
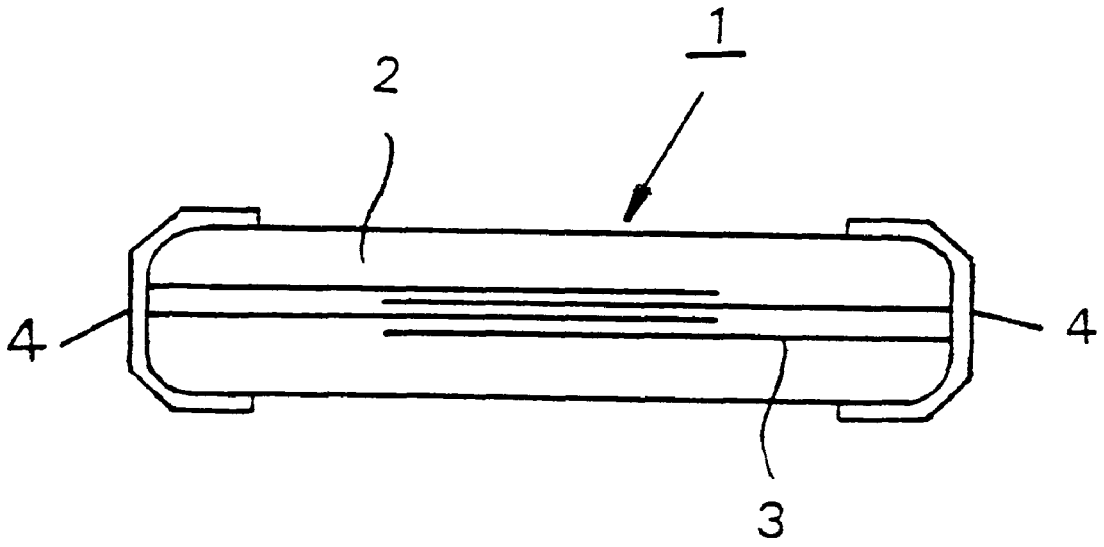
FIG. 1 is a sectional view of the varistor according to the present invention.

A mode for carrying out the present invention will now be described with reference to a preferred embodiment thereof.

First, a commercially available SiC powder was prepared as a raw material powder for a varistor, and the powder was classified into grain diameters less than 1 $\mu$m, grain diameters equal to or greater than 1 $\mu$m and less than 5 $\mu$m, grain diameters equal to or greater than 5 $\mu$m and less than 10 $\mu$m and grain diameters equal to or greater than 10 $\mu$m.

Each of the classified SiC powders (100 mol %) was blended with $SiO_2$, $Bi_2O_3$, PbO, $B_2O_3$ and/or ZnO in the amounts shown in Tables 1 and 2, combined with ethanol and toluene in predetermined amounts, and mixed using a ball mill to obtain slurries.

TABLE 1

| Sample | SiC Grain diameter | Content/mol % | | | | | Electrode |
|---|---|---|---|---|---|---|---|
| No. | $\mu$m | $SiO_2$ | $Bi_2O_2$ | PbO | $B_2O_3$ | ZnO | Material |
| 1 | 1~5 | 0.5 | 0.5 | 0 | 0 | 0 | Pt |
| 2 | 1~5 | 0.5 | 0 | 0.5 | 0 | 0 | Pt |
| 3 | 1~5 | 0.5 | 0 | 0 | 0.5 | 0 | Pt |
| 4 | 1~5 | 0.5 | 0 | 0 | 0 | 0.5 | Pt |
| 5 | 1~5 | 0 | 0.5 | 0 | 0.5 | 0 | Pt |
| 6 | 1~5 | 1 | 1 | 0 | 1 | 0 | Pt |
| 7 | 1~5 | 1 | 0 | 1 | 1 | 0 | Pt |
| 8 | 1~5 | 1 | 0 | 0 | 1 | 1 | Pt |
| 9 | 1~5 | 5 | 5 | 0 | 5 | 0 | Pt |
| 10 | 1~5 | 5 | 0 | 0 | 5 | 5 | Pt |
| 11 | 1~5 | 5 | 5 | 0 | 5 | 5 | Pt |
| 12 | 1~5 | 10 | 10 | 0 | 0 | 0 | Pt |
| 13 | 1~5 | 10 | 0 | 10 | 0 | 0 | Pt |
| 14 | 1~5 | 10 | 0 | 0 | 10 | 0 | Pt |
| 15 | 1~5 | 10 | 0 | 0 | 0 | 10 | Pt |
| 16 | 1~5 | 10 | 10 | 0 | 10 | 0 | Pt |
| 17 | 1~5 | 10 | 10 | 10 | 0 | 0 | Pt |
| 18 | 1~5 | 10 | 0 | 0 | 10 | 10 | Pt |
| 19 | 1~5 | 0 | 0 | 10 | 10 | 10 | Pt |

TABLE 1-continued

| Sample No. | SiC Grain diameter μm | Content/mol % $SiO_2$ | $Bi_2O_2$ | PbO | $B_2O_3$ | ZnO | Electrode Material |
|---|---|---|---|---|---|---|---|
| 20 | less than 1 μm | 5 | 5 | 0 | 5 | 0 | Pt |
| 21 | 5~10 | 5 | 5 | 0 | 5 | 0 | Pt |

Note: "1~5" and "5~10" mean "equal to or greater then 1 and less than 5" and "equal to or greater then 5 and less than 10", respectively.

TABLE 2

| Sample No. | SiC Grain diameter μm | Content/mol % $SiO_2$ | $Bi_2O_2$ | PbO | $B_2O_3$ | ZnO | Electrode Material |
|---|---|---|---|---|---|---|---|
| 22 | 1~5 | 5 | 5 | 0 | 5 | 0 | Au |
| 23 | 1~5 | 5 | 5 | 0 | 5 | 0 | Ag—Pd |
| 24 | 1~5 | 5 | 5 | 0 | 5 | 0 | Pd |
| 25 | 1~5 | 5 | 5 | 0 | 5 | 0 | Ni |
| 26 | 1~5 | 5 | 5 | 0 | 5 | 0 | Cu |
| 27 | 1~5 | 0.05 | 0.05 | 0 | 0 | 0 | Ag—Pd |
| 28 | 1~5 | 0 | 0.05 | 0 | 0.05 | 0 | Ag—Pd |

Next, a binder and a dispersing agent were added to the slurries and, thereafter, ceramic green sheets having a thickness of 20 μm were produced using a doctor blade process. A good ceramic green sheet could not be produced from SiC powders having grain diameters of 10 μm or more.

Each of the ceramic green sheets thus obtained was punched into a predetermined (rectangular) configuration to obtain a plurality of ceramic green sheets therefrom.

Next, as shown in Tables 1 and 2, a paste made of the designated metal and a carrier (mixing ratio 7:3 by weight) was printed using a screen printing process on the surface of the green sheets to form an inner electrode thereon.

A predetermined number of ceramic green sheets thus printed were stacked to form a layered body; a predetermined number of ceramic green sheets having no inner electrode printed thereon were stacked on both of upper and lower sides of the layered body as outer layers; and the resultant layered body was bonded by pressing at a pressure of 2 tons/cm$^2$.

The press-bonded body was subjected to heating at 500 ° C. for two hours to burn and remove the binder and was baked thereafter in Ar at a temperature in the range from 700 to 1100° C.

An Ag paste as an outer electrode was applied to the area on an end face of the resultant baked body where the inner electrodes were exposed and was baked at 600° C. to complete a chip type varistor.

A sectional view of the varistor is shown in FIG. 1. A plurality of inner electrodes 3 are disposed in ceramic layer 2. Outer electrodes 4 are applied on the outer surface of the ceramic layer 2.

The electrical characteristics of such a chip type varistor were measured according to the methods described below.

The varistor characteristic of varistor voltage $V_{1mA}$ was obtained by applying a DC current to measure the voltage across the varistor and by measuring the voltage that appeared when a current of 1 mA, was applied.

The voltage non-linearity coefficient a representing a performance index of the varistor was calculated using the equation shown below from the voltage ($V_{0.1mA}$) which appeared when a current of 0.1 mA was applied and the varistor voltage $V_{1mA}$.

$$\alpha=1/\log(V_{1mA}/V_{0.1mA})$$

Further, the electrostatic capacity at 1 MHz was measured.

The discharge voltage in a high current region was measured as the maximum voltage $V_{10A}$ across the varistor by applying a current pulse having a triangular current waveform of 8×20 μsec. and having a peak current of 10 A to the varistor.

In addition, a current pulse having the same waveform as that for the discharge voltage was applied, and the peak current value which caused a change in the voltage $V_{1mA}$ from the value before the application of the pulse in an amount in the excess of 10% was measured as surge resistance. The peak current value is represented as a current value per unit area of the electrode region of the varistor.

The above-described measurements were made on 10 samples from each lot. The results of the measurement are shown in Tables 3 and 4. The sample numbers shown on Tables 3 and 4 corresponds to the sample numbers in Tables 1 and 2.

TABLE 3

| Sample No. | Varistor Voltage $V_{1\,mA}$ | Non-Linear Coefficient α | Capacitance pF | Discharge Voltage $V_{10\,mA}$ | Surge Resistance A/cm$^2$ |
|---|---|---|---|---|---|
| 1 | 15.8 | 19 | 27 | 55 | 75 |
| 2 | 16.2 | 21 | 25 | 52 | 72 |
| 3 | 16.0 | 18 | 23 | 63 | 63 |
| 4 | 17.6 | 17 | 28 | 51 | 71 |
| 5 | 18.7 | 19 | 32 | 64 | 64 |
| 6 | 22.4 | 24 | 21 | 62 | 78 |
| 7 | 23.5 | 31 | 20 | 65 | 71 |
| 8 | 24.9 | 32 | 17 | 65 | 64 |
| 9 | 22.3 | 28 | 16 | 59 | 67 |
| 10 | 21.6 | 24 | 18 | 62 | 72 |
| 11 | 18.5 | 21 | 19 | 54 | 65 |
| 12 | 21.3 | 28 | 18 | 61 | 73 |
| 13 | 21.1 | 33 | 21 | 63 | 75 |
| 14 | 20.6 | 31 | 20 | 60 | 58 |
| 15 | 22.4 | 29 | 21 | 59 | 62 |
| 16 | 34.8 | 13 | 15 | 125 | 18 |
| 17 | 33.4 | 14 | 14 | 155 | 21 |
| 18 | 38.2 | 12 | 14 | 171 | 15 |
| 19 | 45.6 | 11 | 11 | — | 10 |
| 20 | 85.2 | 15 | 8 | — | 7 |
| 21 | 7.5 | 14 | 32 | 48 | 56 |

TABLE 4

| Sample No. | Varistor Voltage $V_{1\,mA}$ | Non-Linear Coefficient α | Capacitance pF | Discharge Voltage $V_{10\,mA}$ | Surge Resistance A/cm$^2$ |
|---|---|---|---|---|---|
| 22 | 21.0 | 27 | 14 | 54 | 62 |
| 23 | 18.4 | 22 | 14 | 60 | 58 |
| 24 | 22.0 | 24 | 17 | 62 | 55 |
| 25 | 23.9 | 28 | 17 | 58 | 72 |
| 26 | 25.7 | 21 | 18 | 71 | 55 |
| 27 | 16.7 | 16 | 24 | 58 | 73 |
| 28 | 16.2 | 17 | 25 | 61 | 75 |

As apparent from Tables 1 through 4, there is provided chip type varistors having a high voltage non-linearity coefficient α in the range from about 10 to about 30 and a small electrostatic capacity in the range from about 10 to 30 pF by using SiC as a major component and containing at least two elements, in the form of oxides, selected from among Si, Bi, Pb, B and Zn. Further, a surge resistance as high as 50 or more can be achieved.

As indicated by the samples No. 16 through No. 19, when the elements (Si, Bi, Pb, B and Zn) are added in a total amount in the excess of about 20 mol % in terms of the total amount of $SiO_2$, $Bi_2O_3$, PbO, $B_2O_3$ and ZnO, the voltage non-linearity coefficient is low although a small electrostatic capacity is obtained. Further, this results in high resistance at grain boundaries which in turn results in a high discharge voltage and low surface resistance. This has even resulted in breakdown of an element as seen on the sample No. 19. Furthermore, although not shown in Tables 1 through 4, an amount of oxides less than about 0.1 mol % results in a fragile ceramic, which reduces the strength of the varistor.

Therefore, the preferable total amount of Si, Bi, Pb, B and Zn is in the range from about 0.1 to 20 mol % in terms of the total amount of $SiO_2$, $Bi_2O_3$, PbO, $B_2O_3$ and ZnO.

As apparent from the sample No. 20, a grain diameter of SiC powder less than about 1 $\mu$m results in a low voltage non-linearity coefficient. This also results in a significant reduction of surge resistance that can cause breakdown of a varistor. On the other hand, a grain diameter of SiC powder in the excess of about 10 $\mu$m prevents a sheet to be produced. Therefore, the SiC grain diameter is preferably in the range from about 1 to 10 $\mu$m.

As an inner electrode of the chip type varistor, at least one of the metals Pt, Au, Ag, Pd, Ni and Cu can be selected and used as appropriate, taking performance and cost into consideration.

As described above, the present invention makes it possible to provide a chip type varistor which operates on a low voltage, exhibits high voltage non-linearity and high voltage suppressing capability and has a small electronic capacity by forming a varistor mainly composed by SiC in a layered configuration with oxides of Si, Bi, B, Pb and Zn added therein. This makes it possible to achieve voltage non-linearity that is about two to four times that of conventional SiC type varistors and to maintain sufficient surge resistance with a small capacity.

Although the present invention and its advantages have been described in detail, it should be understood that various changes, substitutions and alterations can be made herein without departing from the spirit and scope of the invention.

What is claimed is:

1. A variable resistor comprising:

a ceramic body consisting of SiC and at least two oxides selected from the group consisting of $SiO_2$, $Bi_2O_3$, PbO, $B_2O_3$ and ZnO;

an inner electrode in said ceramic body; and an outer electrode on the surface of said ceramic body and electrically connected to said inner electrode.

2. The variable resistor according to claim 1, consisting of said oxides in an amount of from about 0.1 to 20 mol % in terms of the total amount of the oxides $SiO_2$, $Bi_2O_3$, PbO, $B_2O_3$ and ZnO based on 100 mol % of said SiC.

3. The variable resistor according to claim 2, wherein said SiC has a grain diameter in the range from about 1 to 10 $\mu$m.

4. The variable resistor according to claim 3, wherein said inner electrode is of at least one metal selected from the group consisting of Pt, Au, Ag, Pd, Ni and Cu.

5. The variable resistor according to claim 4, wherein said body consists of two to four of said oxides in an amount of about 3 to 15 mol % and said SiC has a grain diameter of about 1 to less than 5 $\mu$m.

6. The variable resistor according to claim 5, wherein said oxides include $SiO_2$ and said inner electrode comprises Pt.

7. The variable resistor according to claim 1, wherein said SiC has a grain diameter in the range from about 1 to 10 $\mu$m.

8. The variable resistor according to claim 7, wherein said inner electrode is of at least one metal selected from the group consisting of Pt, Au, Ag, Pd, Ni and Cu.

9. The variable resistor according to claim 1, wherein said inner electrode is of at least one metal selected from the group consisting of Pt, Au, Ag, Pd, Ni and Cu.

10. The variable resistor according to claim 1, wherein said body consists of two to four of said oxides in an amount of about 3 to 15 mol % and said SiC has a grain diameter of about 1 to less than 5 $\mu$m.

11. The variable resistor according to claim 1, wherein said ceramic body is disposed in a plurality of layers and there are at least two inner electrodes each of which is disposed between adjacent layers.

12. The variable resistor according to claim 11, consisting of said oxides in an amount of from about 0.1 to 20 mol % in terms of the total amount of the oxides $SiO_2$, $Bi_2O_3$, PbO, $B_2O_3$ and ZnO.

13. The variable resistor according to claim 12, wherein said SiC has a grain diameter in the range from about 1 to 10 $\mu$m.

14. The variable resistor according to claim 13, wherein said inner electrode is of at least one metal selected from the group consisting of Pt, Au, Ag, Pd, Ni and Cu.

15. The variable resistor according to claim 14, wherein said body consists of two to four of said oxides in an amount of about 3 to 15 mol % and said SiC has a grain diameter of about 1 to less than 5 $\mu$m.

16. A ceramic composition consisting of SiC and at least two oxides selected from the group consisting of $SiO_2$, $Bi_2O_3$, PbO, $B_2O_3$ and ZnO.

17. The ceramic composition according to claim 16, wherein the total amount of oxides is in the range from about 0.1 to 20 mol % based on 100 mol % of said SiC.

18. The ceramic composition according to claim 17, wherein said SiC has a grain diameter in the range from about 1 to 10 $\mu$m.

19. The ceramic composition according to claim 16, wherein said SiC has a grain diameter in the range from about 1 to 10 $\mu$m.

20. The ceramic composition according to claim 19, consisting of two to four of said oxides in an amount of about 3 to 15 mol % and said SiC has a grain diameter of about 1 to less than 5 $\mu$m.

21. The ceramic composition of claim 15 in which said at least two oxides are selected from the group consisting of $SiO_2$, $Bi_2O_3$, PbO and $B_2O_3$.

22. A variable resistor according to claim 1 in which said at least two oxides are selected from the group consisting of $SiO_2$, $BiTO_3$, PbO and $B_2O_3$.

* * * * *